US010343016B2

(12) United States Patent
Yamada et al.

(10) Patent No.: US 10,343,016 B2
(45) Date of Patent: Jul. 9, 2019

(54) REHABILITATION DEVICE, CONTROL METHOD, AND RECORDING MEDIUM

(71) Applicants: TOYOTA JIDOSHA KABUSHIKI KAISHA, Toyota-shi, Aichi-ken (JP); TOYOTA SCHOOL FOUNDATION, Nagoya-shi, Aichi-ken (JP)

(72) Inventors: Hitoshi Yamada, Nagakute (JP); Masashi Yamashita, Miyoshi (JP)

(73) Assignees: TOYOTA JIDOSHA KABUSHIKI KAISHA, Toyota (JP); TOYOTA SCHOOL FOUNDATION, Nagoya-shi (JP)

( * ) Notice: Subject to any disclaimer, the term of this patent is extended or adjusted under 35 U.S.C. 154(b) by 89 days.

(21) Appl. No.: 14/312,943

(22) Filed: Jun. 24, 2014

(65) Prior Publication Data

US 2015/0005138 A1 Jan. 1, 2015

(30) Foreign Application Priority Data

Jun. 27, 2013 (JP) ..... 2013-134645

(51) Int. Cl.
*A61H 1/02* (2006.01)
*A63B 24/00* (2006.01)

(52) U.S. Cl.
CPC ..... *A63B 24/0087* (2013.01); *A61H 1/0237* (2013.01); *A61H 1/0274* (2013.01); *A61H 2201/5058* (2013.01); *A63B 2230/00* (2013.01)

(58) Field of Classification Search
CPC ..... A63B 24/0087; A63B 2230/00; A61H 1/0274; A61H 1/0237; A61H 2201/5058
USPC ..... 482/1, 4, 44, 49
See application file for complete search history.

(56) References Cited

U.S. PATENT DOCUMENTS

2004/0106881 A1* 6/2004 McBean ..... A61B 5/04888 601/5
2007/0241696 A1* 10/2007 Lauria ..... B25J 9/102 318/116
2008/0009771 A1* 1/2008 Perry ..... B25J 9/0006 600/587
2008/0071386 A1* 3/2008 McBean ..... A61F 5/0127 623/25

(Continued)

FOREIGN PATENT DOCUMENTS

EP 1 723 941 A1 11/2006
JP 2006-204426 A 8/2006

(Continued)

*Primary Examiner* — Sundhara M Ganesan
(74) *Attorney, Agent, or Firm* — Oliff PLC

(57) ABSTRACT

A rehabilitation device includes: an operation unit operated by a patient under rehabilitation; an operation amount detection unit that detects an operation amount of the operation unit; a driving unit that applies torque to the operation unit; a control unit that controls driving of the driving unit; and a movement state detection unit that detects a movement state of a moving part of the patient. The control unit calculates a target value of the operation amount to be performed on the operation unit based on the movement state detected by the movement state detection unit and a predetermined movement model and controls the driving unit so that the operation amount detected by the operation amount detection unit follows the calculated target value of the operation amount.

9 Claims, 8 Drawing Sheets

(56) References Cited

U.S. PATENT DOCUMENTS

| | | | | |
|---|---|---|---|---|
| 2008/0161937 | A1* | 7/2008 | Sankai | A61H 3/008 623/25 |
| 2008/0294074 | A1 | 11/2008 | Tong et al. | |
| 2009/0259338 | A1* | 10/2009 | Tong | A61H 1/0237 700/258 |
| 2010/0324699 | A1* | 12/2010 | Herr | A61F 2/66 623/27 |
| 2011/0137196 | A1 | 6/2011 | Kakei et al. | |
| 2011/0213267 | A1* | 9/2011 | Kakei | A61B 5/0488 600/546 |
| 2013/0000021 | A1* | 1/2013 | Dolcetti | A63B 71/12 2/455 |
| 2014/0100492 | A1* | 4/2014 | Nagasaka | A61H 3/061 601/34 |

FOREIGN PATENT DOCUMENTS

| | | | |
|---|---|---|---|
| JP | A-2007-185325 | | 7/2007 |
| WO | WO 2009/028221 | A1 | 3/2009 |
| WO | 2009/125397 | A2 | 10/2009 |

* cited by examiner

REHABILITATION DEVICE, CONTROL METHOD, AND RECORDING MEDIUM

INCORPORATION BY REFERENCE

The disclosure of Japanese Patent Application No. 2013-134645 filed on Jun. 27, 2013 including the specification, drawings and abstract is incorporated herein by reference in its entirety.

BACKGROUND OF THE INVENTION

1. Field of the Invention

The present invention relates to a rehabilitation device, a control method, a control program, and a recording medium for carrying out rehabilitation for recovering the physical ability of a patient.

2. Description of Related Art

For physically impaired persons, rehabilitation is carried out to recover their physical ability. Various devices have been developed to carry out rehabilitation efficiently.

For example, an upper limb rehabilitation device on which a patient operates the grip according to a training program displayed on the screen is known (Japanese Patent Application Publication No. 2007-185325 (JP 2007-185325 A).

However, the rehabilitation device described above is not designed to assist a patient in carrying out rehabilitation with full consideration for a patient's operation intention; in other words, the rehabilitation device does not fully consider the physical condition of the patient. Therefore, an attempt to perform the operation as accurately as possible according to the training program requires the patient to apply a relatively powerful operating force. This sometimes leads to a situation in which a patient under rehabilitation cannot carry out rehabilitation suited to him or her.

SUMMARY OF THE INVENTION

The present invention provides a rehabilitation device, a control method, and a recording medium that can efficiently reduce a patient's operation load during rehabilitation considering a patient's operation intention.

One aspect of the present invention relates to a rehabilitation device. The rehabilitation device includes an operation unit operated by a patient under rehabilitation; an operation amount detection unit that detects an operation amount of the operation unit; a driving unit that applies torque to the operation unit; a control unit that controls driving of the driving unit; and a movement state detection unit that detects a movement state of a moving part of the patient. The control unit calculates a target value of the operation amount to be performed on the operation unit based on the movement state detected by the movement state detection unit and a predetermined movement model and controls the driving unit so that the operation amount detected by the operation amount detection unit follows the calculated target value of the operation amount.

Another aspect of the present invention relates to a control method. The control method includes detecting an operation amount of an operation unit operated by a patient under rehabilitation; detecting a movement state of a moving part of the patient; calculating a target value of the operation amount to be performed on the operation unit based on the detected movement state and a predetermined movement model; and controlling a driving unit, which applies torque to the operation unit, so that the detected operation amount follows the calculated target value of the operation amount.

A still another aspect of the present invention relates to a recording medium storing therein a control program. The control program causes a computer to execute processing for calculating a target value of an operation amount to be performed on an operation unit, operated by a patient under rehabilitation, based cm a movement state of a moving part of the patient and a predetermined movement model; and processing for controlling a driving unit, which applies torque to the operation unit, so that a detected operation amount of the operation unit follows the calculated target value of the operation amount.

According to the embodiments of the present invention, the rehabilitation device, the control method, and the recording medium that can efficiently reduce a patient's operation load during rehabilitation considering a patient's operation intention are provided.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
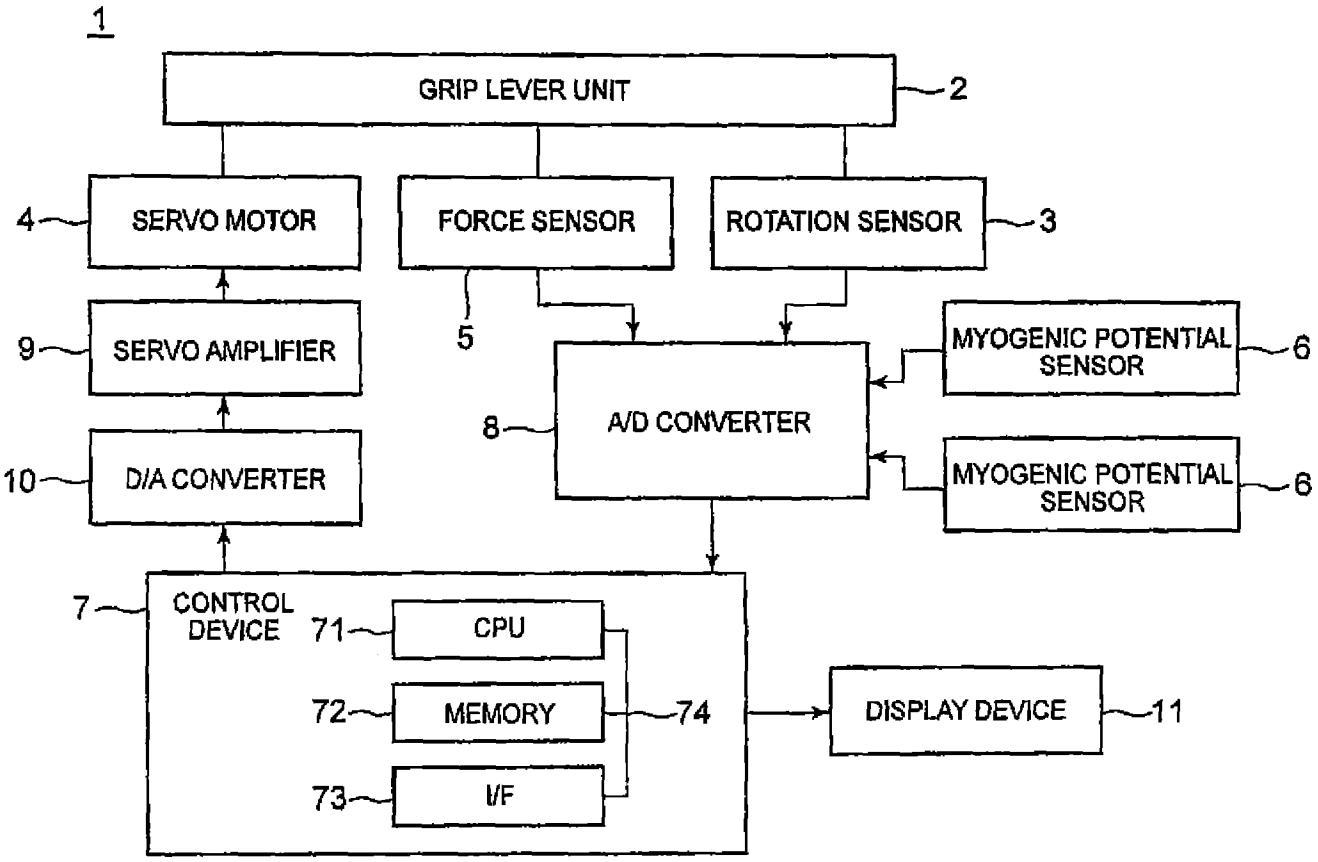
FIG. 1 is a block diagram showing a general system configuration of a rehabilitation device in one embodiment of the present invention.

An embodiment of the present invention is described below with reference to the drawings. FIG. 1 is a block diagram showing a general system configuration of a rehabilitation device in one embodiment of the present invention. A rehabilitation device 1 in this embodiment includes the following: a grip lever unit 2 that is operated by a patient, a rotation sensor 3 that detects the operation amount of the grip lever unit 2, a servo motor 4 that applies an operation torque to the grip lever unit 2, a force sensor 5 that detects an external force applied to the grip lever unit 2, at least one myogenic potential sensor 6 that detects the myogenic potential of a moving part of a patient, a control device 7 that controls the servo motor 4, and a display device 11 that displays various types of operation information.

Figure 2:
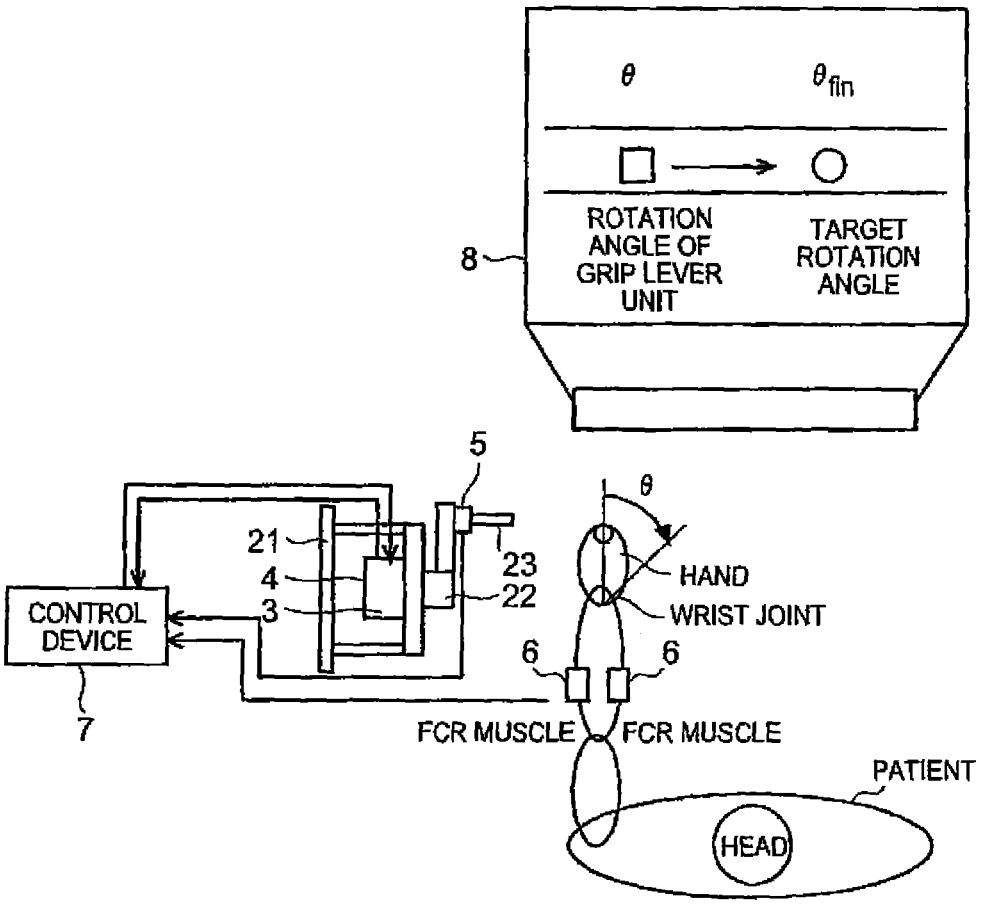
FIG. 2 is a diagram showing the operation of a grip lever unit.

The grip lever unit 2, one example of an operation unit, is used by a patient for an operation to carry out the rehabilitation of an upper limb (FIG. 2). The grip lever unit 2 includes a housing 21, a rotation axis 22 rotatably provided on the housing 21, and a handle 23 linked to the rotation axis 22 and held by a patient. A patient holds the handle 23 and moves the handle 23 in the instructed direction for rehabilitation training.

The rotation sensor 3, one example of an operation amount detection unit, detects the rotation angle of the handle 23 of the grip lever unit 2. The rotation sensor 3, configured for example by a potentiometer or a rotary encoder, is provided on the rotation axis of the servo motor 4. The rotation sensor 3 may also be provided on the rotation axis 22 of the grip lever unit 2. The rotation sensor 3 is connected to the control device 7 via an analog/digital (A/D) converter 8. The rotation sensor 3 outputs the rotation angle signal, generated according to the detected rotation angle of the handle 23 of the grip lever unit 2, to the control device 7.

The servo motor 4, one example of a driving unit, has the function to apply an operation torque to the handle 23 of the grip lever unit 2. The driving shaft of the servo motor 4 is linked to the rotation axis 22 of the grip lever unit 2. The servo motor 4, such as an alternate current (AC) servo motor, includes a deceleration mechanism. The servo motor 4 is connected to the control device 7 via a servo amplifier 9 and a digital/analog (D/A) converter 10. The servo motor 4 applies a rotation torque to the handle 23 of the grip lever unit 2 according to the control signal received from the control device 7.

The force sensor 5, one example of an external force detection unit, detects an external force applied to the handle 23 when a patient operates the grip lever unit 2. The force sensor 5 is provided, for example, at the root of the handle 23 of the grip lever unit 2. The force sensor 5 is connected to the control device 7 via the A/D converter 8. The force sensor 5 outputs the force value signal, generated according to the detected force, to the control device 7.

The myogenic potential sensor 6, one example of a movement state detection unit, detects the myogenic potential in the moving part of the upper limb of a patient. The myogenic potential sensor 6 is attached near each of the extensor carpi radialis longus muscle (ECR) and the flexor carpi radialis longus muscle (FCR) of the patient. The attachment position of the myogenic potential sensor 6 is not limited to the position in the example described above; it can be attached in any moving part that moves when the patient operates the grip lever unit 2. Although a pair of myogenic potential sensors 6 is attached on the patient in the example above, any number of myogenic potential sensors 6 may be attached. Each myogenic potential sensor 6 is connected to the control device 7 via the A/D converter 8. Each myogenic potential sensor 6 outputs the myogenic potential signal, generated according to the detected myogenic potential of the patient, to the control device 7.

The control device 7, one example of a control unit, controls the servo motor 4. The control device 7 calculates a torque instruction value (target value of operation amount), which will be sent to the servo motor 4, based on the force value signal output from the force sensor 5, the myogenic potential signal output from each myogenic potential sensor 6, and a predetermined movement model. The control device 7 generates the control signal according to the calculated torque instruction value and outputs the generated control signal to the servo motor 4. The servo motor 4 applies torque to the grip lever unit 2 according to the control signal received from the control device 7.

The control device 7 is hardware configured mainly by a microcomputer that includes a central processing unit (CPU) 71, a memory 72, and an interface unit (I/F) 73. The CPU 71 performs the operation processing and the control processing. The memory 72 includes a read only memory (ROM), in which operation programs and control programs are stored for execution by the CPU 71, and a random access memory (RAM). The interface unit 73 sends and receives signals to and from an external device. The CPU 71, memory 72, and interface unit 73 are interconnected via a data bus 74.

The display device 11, one example of a display unit, displays various types of operation information about patient operations. The display device 11, which is connected to the control device 7, displays various types of operation information based on the information output from the control device 7.

For example, the display device 11 displays two types of target mark on the display screen at the same time, one is a square target mark and the other is a circular target mark. Those target marks are output from the control device 7. The square target mark corresponds to the current rotation angle of the handle 23 of the grip lever unit 2. The circular target mark corresponds to the target rotation angle the patient wants to achieve. The circular target mark, which indicates the target rotation angle, is the operation target of the rehabilitation of an upper limb. The patient rotates the handle 23 so that the square target mark, which corresponds to the current rotation angle of the handle 23, follows the circular target mark that corresponds to the target rotation angle of the tracking exercise. By doing so, desired rehabilitation is carried out for recovering the articular movement. The rehabilitation method described above is exemplary and is not limited thereto. The display device 11 may be a liquid crystal display device or an organic EL display device.

Meanwhile, a today's typical rehabilitation device does not fully consider the physical condition of a patient. Therefore, an attempt to perform an operation as accurately as possible according to the training program tends to require a patient to apply relatively high force. As a result, a patient under rehabilitation (for example, a patient with hemiplegia after stroke) sometimes cannot carry out rehabilitation most suited to him or her.

In contrast, considering a patient's operation intention, the rehabilitation device 1 in this embodiment performs assist control to adequately assist a patient in operating the handle 23 of the grip lever unit 2. This assist control efficiently reduces the operation load on a patient during rehabilitation.

More specifically, the control device calculates the target value of a virtual operation amount to be performed on the operation unit based on the movement state detected by the movement state detection unit and the predetermined movement model, calculates the target value of an operation amount based on the calculated target value of a virtual operation amount and an external force detected by the external force detection unit, and controls the driving unit so that the operation amount detected by the operation amount detection unit follows the calculated target value of an operation amount.

Still more specifically, the control device calculates a rotation angle target value of a virtual wrist joint by calculating a muscular strength of the moving part based on a myogenic potential detected by the myogenic potential sensor and then solving the predetermined movement model based on the calculated muscular strength.

The predetermined movement model is a model based on an equation of motion about a wrist joint, wherein the equation of motion includes a muscular strength term of the moving part, a moment of inertia term about a wrist joint, an elastic modulus term about the muscular strength, and a viscosity coefficient term about the muscular strength.

To realize the control described above, the control device 7 performs assist control that assists a patient in operating the handle 23 of the grip lever unit 2, based on the force value signal output from the force sensor 5, the myogenic potential signal output from each myogenic potential sensor 6, and the predetermined movement model. In performing the assist control described above, the control device 7 executes the higher-level control system and the loser-level control system that will be described later.

Figure 3:
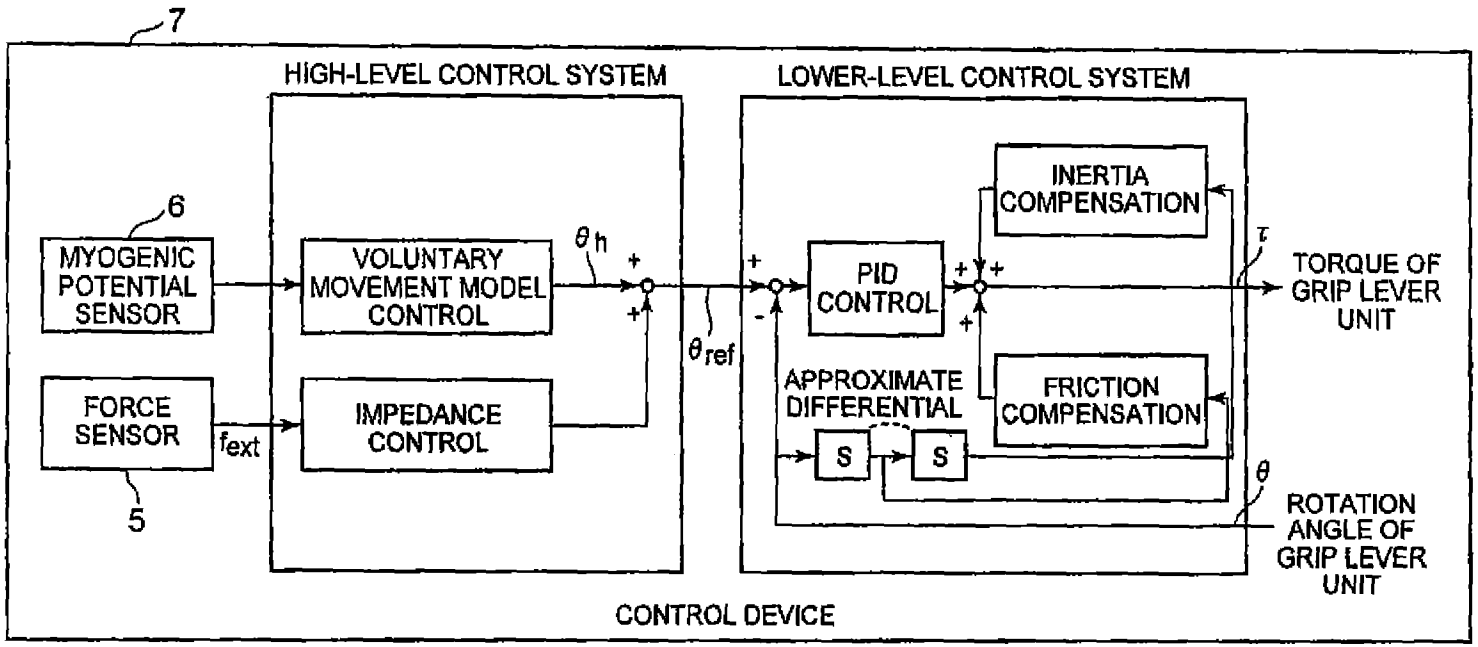
FIG. 3 is a block diagram showing a configuration of an assist control system in one embodiment of the present invention.

FIG. 3 is a block diagram showing a configuration of an assist control system in this embodiment. In the higher-level control system, the control device 7 performs two types of control: voluntary movement model control and impedance control. In the voluntary movement model control, the control device 7 calculates the rotation angle target value (target value of rotation angle) of the virtual wrist joint of a patient based on the myogenic potential signal received from the myogenic potential sensor 6. In the impedance control, the control device 7 increases flexibility in the rotation operation of the handle 23 of the grip lever unit 2 based on the force value signal received from the force sensor 5. The control device 7 combines the voluntary movement model control with the impedance control to calculate the rotation angle target value of a wrist joint and executes the lower-level control system based on the calculated rotation angle target value of the wrist joint.

In the lower-level control system, the control device 7 performs position control in which the rotation angle of the handle 23 of the grip lever unit 2 follows the rotation angle target value of the wrist joint calculated in the higher-level control system. In this position control, the control device 7 performs PID-based feedback control, in which the rotation angle of the handle 23 of the grip lever unit 2 is fed back, and feed forward control, in which inertial compensation and friction compensation are taken into consideration, to calculate a torque instruction value to be sent to the servo motor 4.

Next, the upper-level control system described above is described in detail. In designing the voluntary movement model control, the equation of motion is created, as shown in expression (1) given below, for the movement around a wrist joint when there is no load on the handle 23 of the grip lever unit 2.

$$I_h\ddot{\theta}_h=(u_f-u_e-(K_h\theta_h+B_h\dot{\theta}_h))L_h \quad \text{Expression (1)}$$

In expression (1), $I_h$ indicates the moment of inertia of the wrist joint, and $\theta_h$ indicates the rotation angle of the wrist joint. $u_f$ indicates the muscular strength of the flexor carpi radialis longus muscle, and $u_e$ indicates the muscular strength of the extensor carpi radialis fungus muscle. $K_h$ indicates the elastic modulus of the flexor carpi radialis longus muscle and the extensor carpi radialis longus muscle, and $B_h$ indicates the viscosity coefficient of the flexor carpi radialis longus muscle and the extensor carpi radialis longus muscle. $L_h$ indicates the length of the lever arm of the wrist joint (length from the wrist joint to the center of the handle 23).

Figure 4:
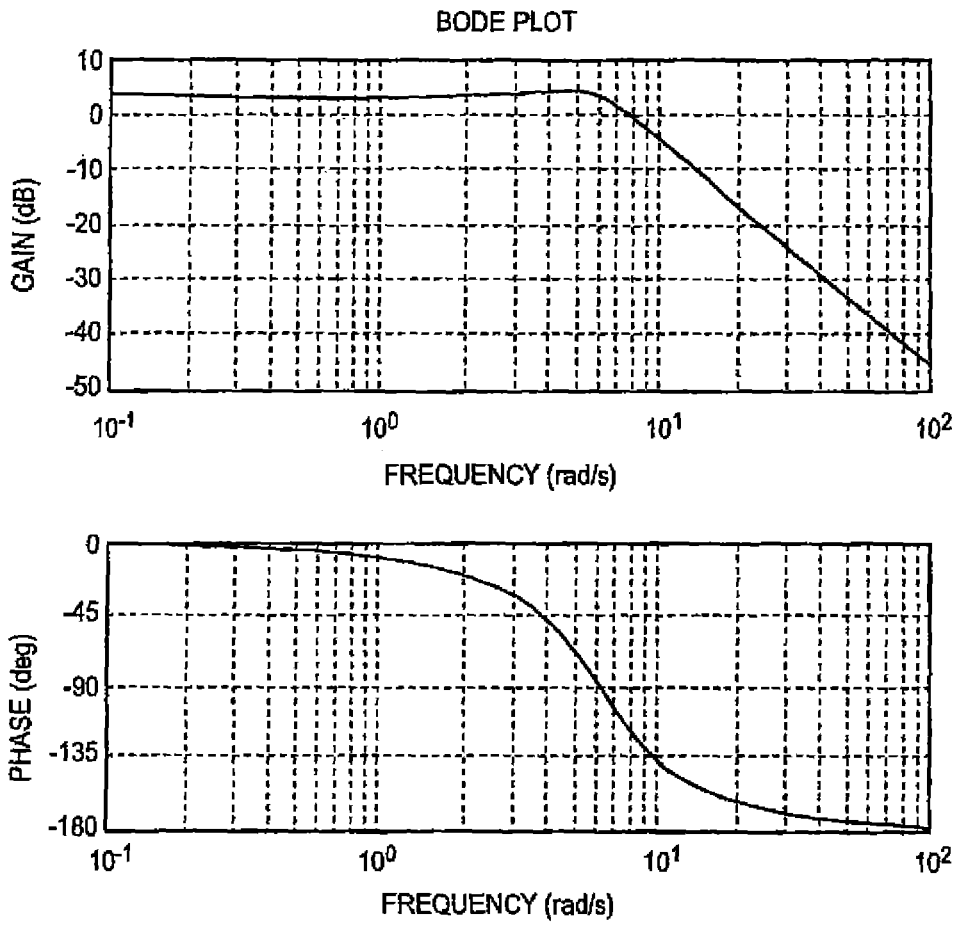
FIG. 4 is a diagram showing one example of the frequency characteristic of a voluntary movement model.

FIG. 4 is a diagram showing one example of the frequency characteristic of the voluntary movement model represented by expression (1) given above. The muscular strength $u_f$ of the flexor carpi radialis longus muscle and the muscular strength $u_c$ of the extensor carpi radialis longus muscle are proportional to the IEMG signals $r_f$ and $r_r$. The IEMG signals are those generated by rectifying the myogenic potential signals $y_{emg_f}$ and $y_{emg_c}$, output respectively from the corresponding myogenic potential sensor 6 and then smoothing the generated signals using a low pass filter with a time constant of $T_{ave}$=0.05 sec. Therefore, the voluntary movement model can be represented by expression (2) to expression (5) given below.

$$\gamma_f=(T_{ave}s+1)^{-1}|y_{emg_f}| \quad \text{Expression (2)}$$

$$\gamma_e=(T_{ave}s+1)^{-1}|y_{emg_e}| \quad \text{Expression (3)}$$

$$u_f=G_f\cdot\gamma_f \quad \text{Expression (4)}$$

$$u_e=G_e\cdot\gamma_e \quad \text{Expression (5)}$$

In expressions (4) and (5) given above, $G_f$ and $G_e$ indicate the conversion constant for converting the IEMG signal to a muscular strength.

The control device 7 calculates the rotation angle target value $\theta_h$ of the virtual wrist joint by solving the voluntary movement model about the wrist joint, composed of expression (1) to expression (5) given above, as necessary, based on the myogenic potential signals $y_{emg_f}$ and $y_{emg_e}$ output from the myogenic potential sensors 6. The control device 7 executes the lower-level control system, which will be described later, based on the calculated rotation angle target value $\theta_h$ of the virtual wrist joint. Therefore, even when a patient's operation intention is slight, the articular movement can be reproduced according to the operation intention.

In addition, the control device 7 performs the impedance control, shown in expression (6) given below, based on the calculated rotation angle target value $\theta_h$ of the virtual wrist joint. That is, based on the calculated rotation angle target value of the virtual wrist joint and on the external force detected by the external force detection unit, the control device performs the impedance control, which includes the damping coefficient and the stiffness coefficient, to calculate the rotation angle target value of the wrist joint. This impedance control increases flexibility in the rotation operation of the handle 23 of the grip lever unit 2 to compensate for a difference between the rotation angle target value $\theta_h$ of the wrist joint and the actual rotation angle of the wrist joint according to the force value signal output from the force sensor 5. Therefore, this flexibility enables the patient to perform an easy, light-load operation.

$$\theta_{ref}=\theta_h+(sD_{imp}+K_{imp})^{-1}f_{ext} \quad \text{Expression (6)}$$

In expression (6) given above, s indicates the Laplacian operator, $D_{imp}$ indicates the damping coefficient of the impedance control, and $K_{imp}$ indicates the stiffness coefficient of the impedance control. $f_{ext}$ indicates the force value signal (external force) output from the force sensor 5. This external force is, for example, a force applied to the handle 23 of the grip lever unit 2 in the radial direction wherein the clockwise direction is positive. $\theta_{ref}$ indicates the rotation angle target value of the wrist joint. By adjusting the damping coefficient $D_{imp}$ and the stiffness coefficient $K_{imp}$ of the impedance control in expression (6) given above, the user can easily adjust the flexibility in the rotation operation of the handle 23. The ability to optimally adjust the flexibility in the rotation operation according to the physical condition of the patient in this manner efficiently reduces the operation load on the patient.

In this embodiment, the user can change the damping coefficient $D_{imp}$ and the stiffness coefficient $K_{imp}$ of the impedance control, which are set in the control device 7, via an input device (one example of a change unit) such as a keyboard or a touch screen.

Next, the lower-level control system described above is described in detail. In the lower-level control system, the control device 7 performs the position control in which the rotation angle of the handle 23 of the grip lever unit 2 follows the rotation angle target value $\theta_{ref}$ of the wrist joint calculated in the higher-level control system. Here, the equation of motion of the machine system, composed of the controlled servo motor 4 and the handle 23 of the grip lever unit 2, can be represented as shown by expression (7) given below.

$$\tau = I_m\ddot{\theta} + B_m\dot{\theta}\,\mathrm{sgn}(\dot{\theta}) \qquad \text{Expression (7)}$$

In expression (7) given above, $I_m$ indicates the moment of inertia of the handle 23 of the grip lever unit 2, $B_m$ indicates the viscous friction term coefficient, $D_m$ indicates the dynamic friction coefficient, $\tau$ indicates the torque instruction value that drives the servo motor 4, and $\theta$ indicates the rotation angle of the handle 23 of the grip lever unit 2, respectively.

Based on expression (7) given above, the lower-level control system shown in expression (8) below can be built. This lower-level control system includes an inertia compensation unit, a friction compensation unit, and a PID-based feedback unit. This lower-level control system, which includes the inertia compensation unit and, in particular, the friction compensation unit, enables the use of a low-cost servo motor 4, thus resulting in cost reduction.

$$\tau = K_p(\theta_{ref}-\theta) + K_i\int(\theta_{ref}-\theta)dt + K_d(\dot{\theta}_{ref}-\dot{\theta}) + \hat{I}_m\ddot{\theta} + \hat{B}_m\dot{\theta} + \hat{D}_m\,\mathrm{sgn}(\dot{\theta}) \qquad \text{Expression (8)}$$

In expression (8) given above, $K_p$, $k_i$, and $K_d$ indicate the proportional gain, the integration gain, and the derivative gain of the PID based feedback control, respectively. $\hat{I}_m$, $\hat{B}_m$, and $\hat{D}_m$ indicate the moment of inertia, the viscous friction term coefficient, and the dynamic friction coefficient respectively that are offline-identified by the least squares method for inertia compensation and friction compensation.

The control device 7 calculates the torque instruction value $\tau$, which is sent to the servo motor 4, so that the rotation angle $\theta$ of the handle 23 of the grip lever unit 2, detected by the rotation sensor 3, follows the rotation angle target value $\theta_{ref}$ of the wrist joint calculated by expression (8) given above. More specifically, the control device solves the control system, which includes the inertia compensation term, friction compensation term, and feedback compensation term, based on the calculated rotation angle target value of the wrist joint. By doing so, the control unit calculates the torque instruction value, which is sent to the driving unit, so that the rotation angle of the operation unit, detected by the operation amount detection unit, follows the target value of the calculated rotation angle of the wrist joint. The control device 7 generates the control signal according to the calculated torque instruction value $\tau$ and outputs the generated control signal to the servo motor 4 to control the servo motor 4.

Figure 5:
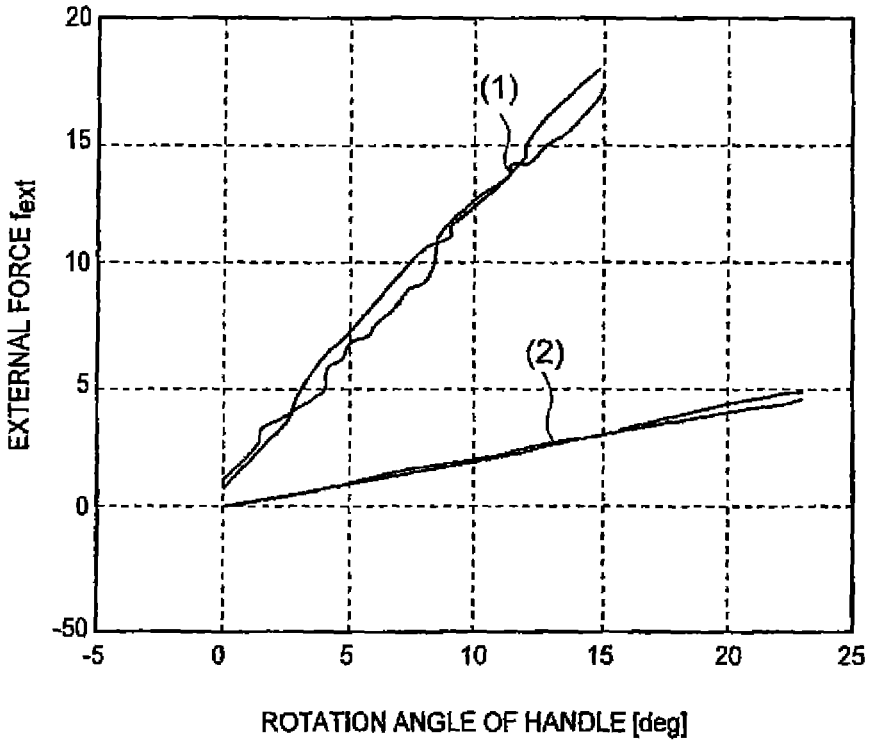
FIG. 5 is a diagram showing the effect of an impedance control that increases flexibility in the rotation operation of the handle of the grip lever unit according to the force value signal output from a force sensor.

FIG. 5 is a diagram showing the effect of the impedance control that increases flexibility in the rotation operation of the handle of the grip lever unit according to the force value signal output from the force sensor. As shown in FIG. 5, this impedance control realizes two types of stiffness characteristic, (1) and (2). The figure shows that, when the rotation angle of the handle 23 of the grip lever unit 2 is increased, the increase in the force value of the force sensor 5 according to the stiffness characteristic (2) is smaller than the increase in the force value of the force sensor 5 according to the stiffness characteristic (1). This means that the stiffness characteristic (2) allows a patient to operate the handle 23 of the grip lever unit 2 with a smaller operation force (more flexibly) than the stiffness characteristic (1).

Adjusting the stiffness characteristic such as that shown in FIG. 5 (represented by the slope of an increase in the force value, detected by the force sensor 5, with respect to the rotation angle of the handle 23 of the grip lever unit 2) enables a patient to carry out rehabilitation best suited to his or her physical condition.

Figure 6A:
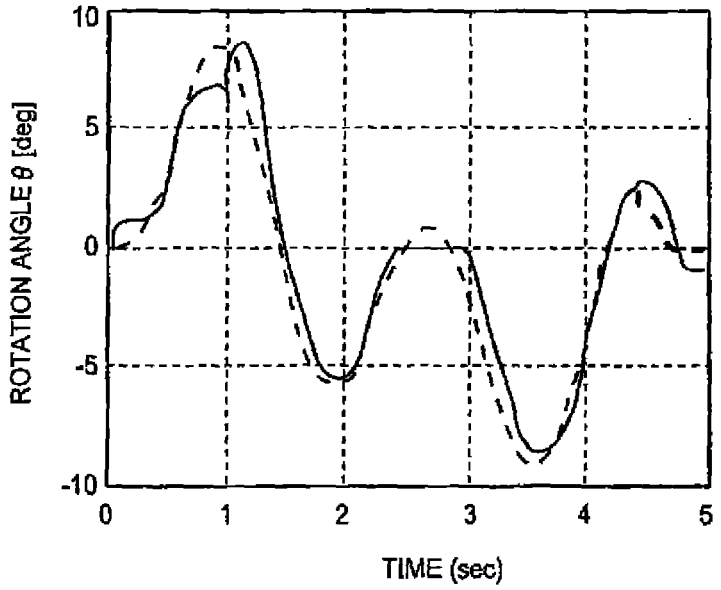
FIG. 6A is a diagram showing a comparison between the rotation angle target value of a wrist joint and the rotation angle detected by a rotation sensor when assist control is performed by the control device in one embodiment of the present invention.
Figure 7A:
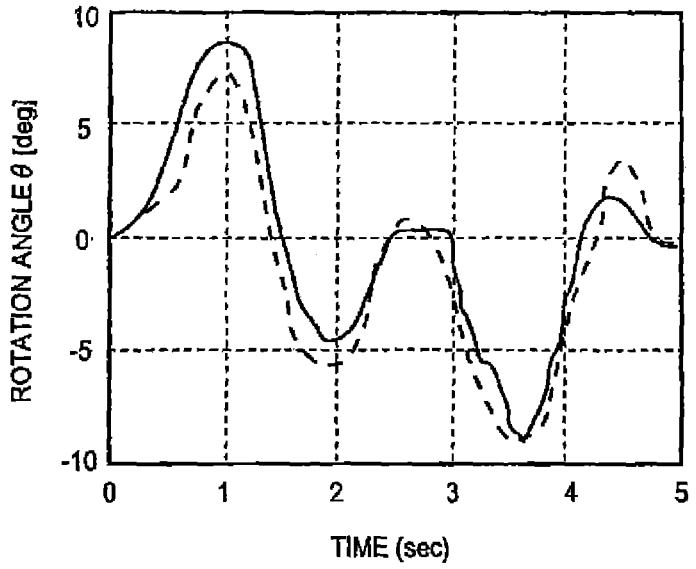
FIG. 7A is a diagram showing a comparison between the rotation angle target value of a wrist joint and the rotation angle detected by a rotation sensor when assist control is not performed by the control device in one embodiment of the present invention.

FIG. 6A is a diagram showing the comparison between the rotation angle target value of the wrist joint and the rotation angle detected by the rotation sensor when assist control is performed by the control device in this embodiment. FIG. 7A is a diagram showing the comparison between the rotation angle target value of the wrist joint and the rotation angle detected by the rotation sensor when assist control is not performed by the control device in this embodiment.

The above comparison indicates that, when the assist control in this embodiment is performed as shown in FIG. 6A, the rotation angle, detected by the rotation sensor 3, follows the rotation angle target value of the wrist joint more accurately than when assist control is not performed as shown in FIG. 7A. That is, the above comparison indicates that the assist control in this embodiment increases the patient's tracking performance.

Figure 6B:
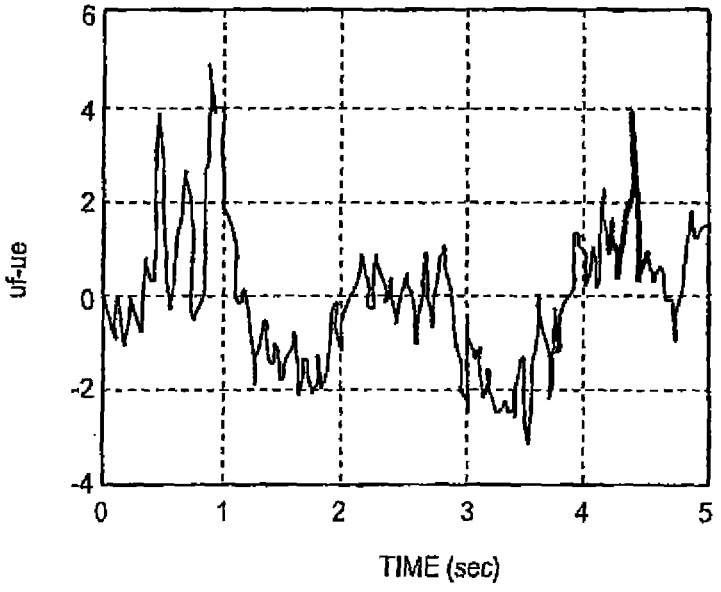
FIG. 6B is a diagram showing a difference in muscle strength between the FCR muscle and the ECR muscle when assist control is performed by the control device in one embodiment of the present invention.
Figure 7B:
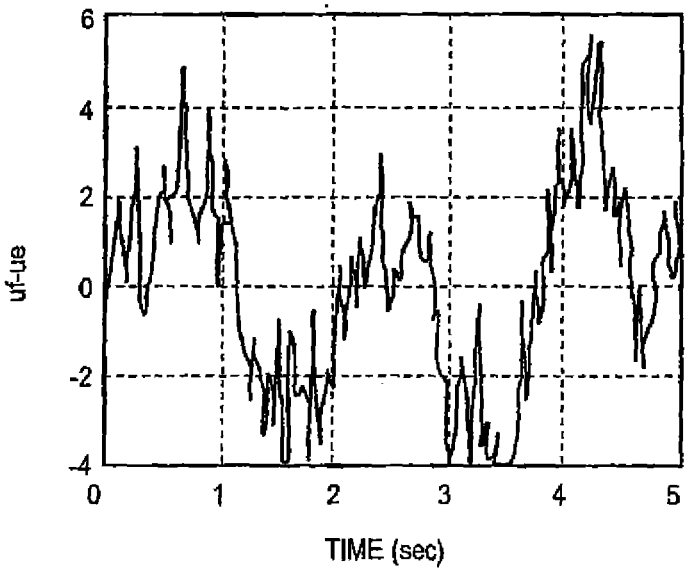
FIG. 7B is a diagram showing a difference in muscle strength between the FCR muscle and the ECR muscle when assist control is not performed by the control device in one embodiment of the present invention.

FIG. 6B is a diagram showing the difference in muscle strength between the FCR muscle and the ECR muscle ($u_f$–$u_e$) when assist control is performed by the control device in this embodiment. FIG. 7B is a diagram showing the difference in muscle strength between the FCR muscle and the ECR muscle ($u_f$–$u_e$) when assist control is not performed by the control device in this embodiment. The difference in muscle strength between the FCR muscle and the ECR muscle corresponds to the operation torque when the rotation operation of the handle 23 of the grip lever unit 2 is performed. This means that the smaller the variation in the difference in muscle strength is, the smaller the operation torque of the handle 23 is and the more flexibly the handle 23 can be operated.

The above comparison indicates that the variation in the difference in muscle strength between the FCR muscle and the ECR muscle can be kept smaller when assist control is performed by the control device 7 in this embodiment as shown in FIG. 6B than when assist control is not performed as shown in FIG. 7B. This therefore implies that, with the assist control performed by the control device 7 in this embodiment, a patient can flexibly operate the handle 23 of the grip lever unit 2 with a smaller operation torque. In summary, as shown in FIGS. 6A and 6B and FIGS. 7A and 7B, the control device 7 in this embodiment, which performs assist control, allows a patient to flexibly perform the operation with a smaller operation torque and, at the same time, realize good tracking performance for the rehabilitation exercise. That is, the assist control allows a patient to perform a desired exercise according to a slight operation intention, efficiently reducing the patient's operation load during rehabilitation.

Figure 8:
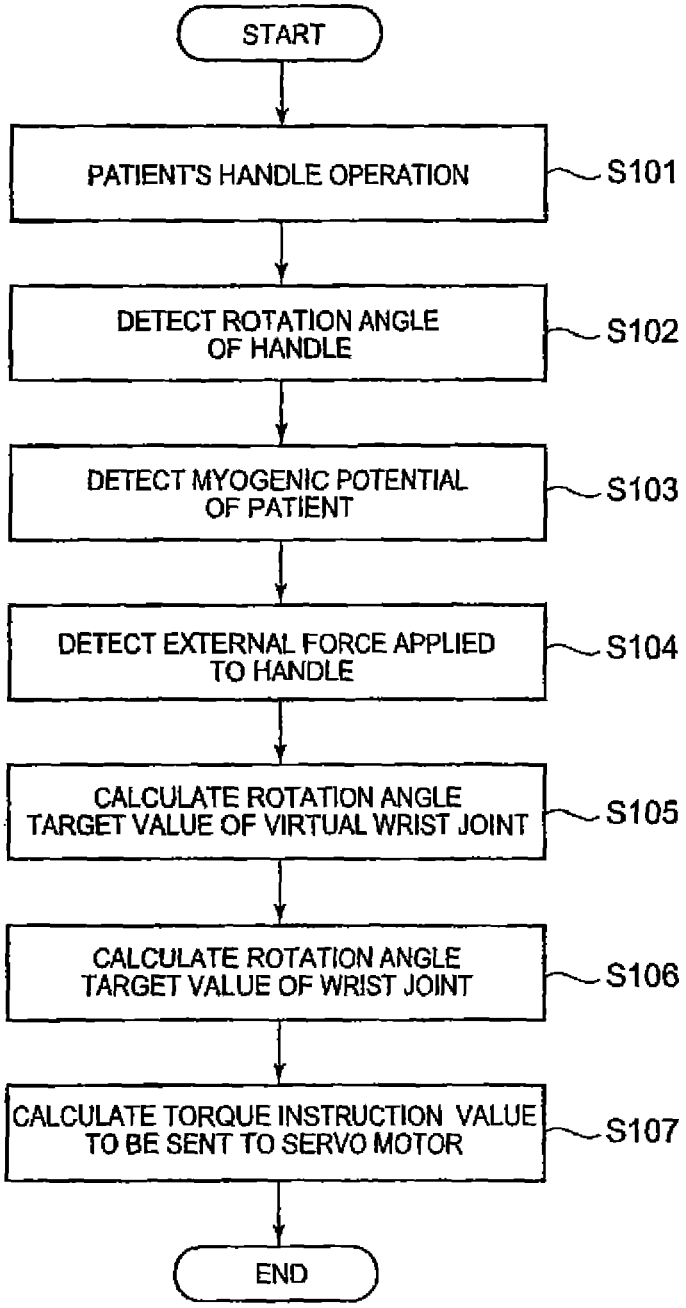
FIG. 8 is a flowchart showing the control processing flow performed by the rehabilitation device in one embodiment of the present invention.

Next, the control method performed by the rehabilitation device in this embodiment is described below in detail. FIG. 8 is a flowchart showing the control processing flow of the rehabilitation device in this embodiment. The control processing shown in FIG. 8 is executed repeatedly at regular intervals.

A patient holds the handle 23 of the grip lever unit 2 and operates the handle 23 so that the target mark of the current rotation angle exactly follows the target mark of the target rotation angle of the handle 23 displayed on the display screen of the display device 8 (step S101).

The rotation sensor 3 detects the rotation angle of the handle 23 of the grip lever unit 2 and outputs the rotation angle signal θ, generated according to the detected rotation angle, to the control device 7 (step S102).

The myogenic potential sensors 6 detects the myogenic potentials of the flexor carpi radialis longus muscle and the extensor carpi radialis longus muscle of the patient and outputs the myogenic potential signals $y_{emg_f}$ and $y_{emg_e}$, each generated according to the detected myogenic potential, to the control device 7 (step S103).

The force sensor 5 detects an external force, applied to the handle 23 of the grip lever unit 2, and outputs the force value signal $f_{ext}$, generated according to the detected external force, to the control device 7 (step S104).

The control device 7 calculates the rotation angle target value $\theta_h$ of the virtual wrist joint based on the myogenic potential signals $y_{emg_f}$ and $y_{emg_e}$ output from the myogenic potential sensors 6 and the voluntary movement model about the wrist joint indicated by expressions (1) to (5) given above (step S105).

The control device 7 calculates the rotation angle target value $\theta_{ref}$ of the wrist joint based on the calculated, rotation angle target value $\theta_h$ of the virtual wrist joint, force value signal $f_{ext}$ output from the force sensor 5, and expression (6) given above prepared for performing the impedance control (step S106).

The control device 7 calculates the torque instruction value τ, which is sent to the servo motor 4, using expression (8) given above so that the rotation angle θ of the handle 23 of the grip lever unit 2, detected by the rotation sensor 3, follows the rotation angle target value $\theta_{ref}$ of the wrist joint calculated by expression (6) given above (step S107). The control device 7 generates the control signal according to the calculated torque instruction value τ and outputs the generated control signal to the servo motor 4 to control the servo motor 4 (step S108).

As described above, the rehabilitation device 1 in this embodiment calculates the rotation angle target value of the virtual wrist joint based on the myogenic potential of the patient's moving part detected by the myogenic potential sensors 6 and on the voluntary movement model, calculates the rotation angle target value of the wrist joint based on the calculated rotation angle target value of the virtual wrist joint and the external force detected by the force sensor 5, and controls the servo motor 4 so that the rotation angle detected by the rotation sensor 3 follows the calculated rotation angle target value of the wrist joint. In this manner, the rehabilitation device 1 performs assist control for the handle 23 of the grip lever unit 2 with consideration for a patient's operation intention, efficiently reducing the operation load on the patient during rehabilitation.

The present invention is not limited to the embodiment described above but may be changed as necessary without departing from the spirit of the present invention.

In one embodiment described above, the control device 7 calculates the rotation angle target value $\theta_h$ of the virtual wrist joint based on the myogenic potential signals output from the myogenic potential sensors 6 and on the voluntary movement model. Instead of this, the control device 7 may calculate the rotation angle target value of the virtual wrist joint based on the signal output from an inertia sensor and on the voluntary movement model. For example, the inertial sensor is attached near the wrist joint and the root of the thumb (moving part). That is, the movement state detection unit may be an inertia sensor that detects the inertia of the moving part of the patient.

In addition, in one embodiment described above, the control device 7 may calculate the rotation angle target value $\theta_h$ of the virtual wrist joint based on the photographed image of a moving part and on the voluntary movement model. For example, a marker is attached near the wrist joint and the root of the thumb (moving part) and the markers are photographed by a camera. The camera outputs the photographed image of the photographed markers on the moving part to the control device 7. That is, the movement state detection unit may be a camera that photographs the markers attached on the moving part of the patient.

In one embodiment described above, the control device 7 calculates the rotation angle target value $\theta_h$ of the virtual wrist joint of a patient and performs the impedance control based on the calculated rotation angle target value $\theta_h$ of the virtual wrist joint. Instead of this, the control device 7 may be configured not to perform the impedance control. In this case, the control device 7 calculates the rotation angle target value $\theta_h$ of the virtual wrist joint based on the myogenic potential signals $y_{emg_r}$ and $y_{emg_e}$ output from the myogenic potential sensors 6 and on the voluntary movement model about the wrist joint indicated by expressions (1) to (5) given above. After that, the control device 7 calculates the torque instruction value τ, which is sent to the servo motor 4, so that the rotation angle θ of the handle 23 of the grip lever unit 2, detected by the rotation sensor 3, follows the calculated rotation angle target value $\theta_h$ of the virtual wrist joint. This configuration eliminates the need for the force sensor, thus leading to a simplified configuration. This configuration is particularly efficient when the physical condition of a patient is so good that flexibility in the rotation operation of the handle 23 is not necessary.

On the other hand, when the physical condition of a patient is not so good (for example, immediately after the patient starts rehabilitation or when the patient's physical condition is very bad), it is very efficient for the control device 7 to perform the impedance control to increase flexibility in the rotation operation of the handle 23 for reducing the operation load on the patient.

The present invention may be implemented also by causing the CPU 71 to execute a computer program to perform the processing shown in FIG. 8.

The program may be stored using various types of non-transitory computer readable medium for distribution to a computer. The non-transitory computer readable media include various types of tangible storage medium. Examples of a non-transitory computer readable medium include a magnetic recording medium (for example, flexible disk, magnetic tape, hard disk drive), a magnet-optical recording medium (for example, magneto-optical disk), a compact disc read-only memory (CD-ROM), a compact disc readable (CD-R), a compact disc rewritable (CD-R/W), and a semiconductor memory (for example, mask ROM, programmable ROM (PROM), erasable PROM (EPROM), flash ROM, and random access memory (RAM)).

The program may also be distributed to a computer via various types of transitory computer readable medium. Examples of a transitory computer readable medium include an electric signal, an optical signal, and an electromagnetic wave. A transitory computer readable medium can distribute the program to a computer via a wired communication path, such as an electric wire and an optical fiber, or a wireless communication path.

What is claimed is:

1. A rehabilitation device comprising:

a lever operated by a patient under rehabilitation;

a rotation sensor that detects an operation amount of the lever;

a motor that applies torque to the lever;

a controller that controls driving of the motor; and a movement state detection unit that detects a movement state of a moving part of the patient, based on a predetermined movement model that is an equation of motion about a joint of the patient, the equation of motion including a muscular strength term of the moving part, a moment of inertia term about the joint, an elastic modulus term, and a viscosity coefficient term, wherein:

the controller controls the motor so that the torque applied to the lever is based on the movement state, and the controller calculates a target value of the operation amount to be performed on the lever based on the movement state detected by the movement state detection unit and controls the motor so that a difference between the operation amount detected by the rotation sensor and the calculated target value of the operation amount decreases as a condition of the patient improves.

2. The rehabilitation device according to claim 1, further comprising:

a force sensor that detects an external force applied to the lever, wherein the controller calculates a target value of a virtual operation amount to be performed on the lever based on the movement state detected by the movement state detection unit, calculates the target value of the operation amount based on the calculated target value of the virtual operation amount and the external force detected by the force sensor, and controls the motor so that the operation amount detected by the rotation sensor follows the calculated target value of the operation amount.

3. The rehabilitation device according to claim 2, wherein:

the movement state detection unit is a myogenic potential sensor that detects myogenic potentials of the moving part of the patient, and the controller calculates a rotation angle target value of a virtual wrist joint by calculating a muscular strength of the moving part based on the myogenic potentials detected by the myogenic potential sensor and then solving the predetermined movement model based on the calculated muscular strength.

4. The rehabilitation device according to claim 3, wherein the controller performs impedance control, based on the calculated rotation angle target value of the virtual wrist joint and the external force detected by the force sensor, to calculate a rotation angle target value of the wrist joint, the impedance control including a damping coefficient and a stiffness coefficient.

5. The rehabilitation device according to claim 4, further comprising:

an input device configured to change the damping coefficient and the stiffness coefficient of the impedance control.

6. The rehabilitation device according to claim 4, wherein the controller solves a control system, which includes an inertia compensation term, a friction compensation term, and a feedback compensation term, based on the calculated rotation angle target value of the wrist joint to calculate a torque instruction value to be sent to the motor so that a rotation angle of the lever, detected by the rotation sensor, follows the calculated rotation angle target value of the wrist joint.

7. The rehabilitation device according to claim 2, wherein:

the movement state detection unit is an inertial sensor that detects an inertia of the moving part of the patient or a camera that photographs a marker attached on the moving part of the patient, and the controller calculates a rotation angle target value of a virtual wrist joint by solving the predetermined movement model based on the detected inertia or a photographed image of the marker.

8. A control method comprising:

detecting an operation amount of an lever operated by a patient under rehabilitation;

detecting a movement state of a moving part of the patient, based on a predetermined movement model that is an equation of motion about a joint of the patient, the equation of motion including a muscular strength term of the moving part, a moment of inertia term about the joint, an elastic modulus term, and a viscosity coefficient term, calculating a target value of the operation amount to be performed on the lever based on the detected movement state;

controlling a motor, which applies torque to the lever, so that a difference between the detected operation amount and the calculated target value of the operation amount decreases as a condition of the patient improves; and controlling the motor so that the torque applied to the lever is based on the movement state.

9. A recording medium storing therein a control program wherein:

the control program causes a computer to execute processing for:

calculating a target value of an operation amount to be performed on an lever, operated by a patient under rehabilitation, based on a movement state of a moving part of the patient and a predetermined movement model that is an equation of motion about a joint of the patient, the equation of motion including a muscular strength term of the moving part, a moment of inertia term about the joint, an elastic modulus term, and a viscosity coefficient term, processing for controlling a motor, which applies torque to the lever, so that a difference between a detected operation amount of the lever and the calculated target value of the operation amount decreases as a condition of the patient improves; and processing for controlling the motor so that a torque applied to the lever is based on the movement state.

* * * * *